US009841176B2

(12) United States Patent
Schwarz et al.

(10) Patent No.: US 9,841,176 B2
(45) Date of Patent: Dec. 12, 2017

(54) LAMP

(71) Applicant: Eaton Protection Systems IP GmbH & Co. KG, Schönefeld (DE)

(72) Inventors: Gerhard Schwarz, Schönbrunn (DE); Jens Burmeister, Eberbach (DE)

(73) Assignee: Eaton Protection Systems IP GmbH & Co. KG, Schonefeld (DE)

( * ) Notice: Subject to any disclaimer, the term of this patent is extended or adjusted under 35 U.S.C. 154(b) by 0 days.

(21) Appl. No.: 14/911,428

(22) PCT Filed: Aug. 13, 2013

(86) PCT No.: PCT/EP2013/002432

§ 371 (c)(1),
(2) Date: Feb. 10, 2016

(87) PCT Pub. No.: WO2015/021996

PCT Pub. Date: Feb. 19, 2015

(65) Prior Publication Data

US 2016/0195256 A1 Jul. 7, 2016

(51) Int. Cl.
*F21V 29/77* (2015.01)
*F21V 31/00* (2006.01)
(Continued)

(52) U.S. Cl.
CPC ..... *F21V 29/77* (2015.01); *F21V 7/0008* (2013.01); *F21V 7/043* (2013.01); *F21V 7/22* (2013.01); *F21V 15/015* (2013.01); *F21V 17/12* (2013.01); *F21V 29/505* (2015.01); *F21V 29/507* (2015.01); *F21V 31/00* (2013.01);
(Continued)

(58) Field of Classification Search
CPC ..... F21V 29/77; F21V 29/505; F21V 29/507; F21V 7/008; F21V 7/045; F21V 7/22; F21V 15/015; F21V 17/12; F21V 31/00; F21V 31/005
See application file for complete search history.

(56) References Cited

U.S. PATENT DOCUMENTS

2007/0263393 A1* 11/2007 Van De Ven ..... F21V 29/2212 362/362
2011/0080741 A1* 4/2011 Noh ..... F21S 8/026 362/294
2011/0199767 A1* 8/2011 Marquardt ..... A47F 3/001 362/235

FOREIGN PATENT DOCUMENTS

DE 10 2010 037 920 4/2011
WO 2012105828 8/2012

OTHER PUBLICATIONS

Translation of DE 10 2010 037 920 generated from Lexis Nexis Total Patents, 5 pages.

(Continued)

*Primary Examiner* — Mary Ellen Bowman
(74) *Attorney, Agent, or Firm* — King & Spalding LLP

(57) ABSTRACT

The invention relates to a lamp (1) comprising a lamp housing (2), a light source (3) disposed in the lamp housing (2), a reflection device (4) associated with the light source (3) for deflection of light emitted by the light source (3) in the direction of a light outlet opening (5) of the lamp housing (2), and a cooling device (6) associated with the light source (3) and/or with the lamp housing (2). In particular an inner side (7) of the lamp housing (2) is formed at least in some locations as the reflection device (4) and/or the cooling device (6) is formed in one piece with the lamp housing (2).

8 Claims, 1 Drawing Sheet

(51) Int. Cl.

| | |
|---|---|
| ***F21V 7/00*** | (2006.01) |
| ***F21V 7/22*** | (2006.01) |
| ***F21V 29/505*** | (2015.01) |
| ***F21V 29/507*** | (2015.01) |
| ***F21V 7/04*** | (2006.01) |
| ***F21V 15/015*** | (2006.01) |
| ***F21V 17/12*** | (2006.01) |
| *F21V 25/12* | (2006.01) |
| *F21V 29/00* | (2015.01) |
| *F21Y 103/10* | (2016.01) |
| *F21Y 115/10* | (2016.01) |

(52) U.S. Cl.

CPC ..... *F21V 31/005* (2013.01); *F21V 7/005* (2013.01); *F21V 25/12* (2013.01); *F21V 29/004* (2013.01); *F21Y 2103/10* (2016.08); *F21Y 2115/10* (2016.08)

(56) References Cited

OTHER PUBLICATIONS

Menn, Patrick, European Patent Office, International Search Report issued in International Application No. PCT/EP2013/002432, completion date Mar. 31, 2014, dated Apr. 4, 2014, 6 pages.

* cited by examiner

LAMP

PRIORITY CLAIM

The present application is national phase application of and claims priority to International Application No. PCT/EP2013/002432 with an International filing date of Aug. 13, 2013. The foregoing application is hereby incorporated herein by reference.

TECHNICAL FIELD

The invention relates to a lamp comprising a housing, a light source arranged in the lamp housing, a reflection device associated with the light source for deflection of light emitted by the light source in the direction of a light outlet opening of the housing, and a cooling device associated with the light source and/or the housing.

BACKGROUND

Such a lamp is known, for example, from DE 10 2011 017 161.

A specific LED carrier is in the known lamp provided for LEDs as a light source. In addition, a separate lamp reflector is used for indirect light emission, where the lamp reflector is composed of a number of substantially linear and curved reflector surfaces. Cooling fins are arranged on the LED carrier as part of a cooling device.

A respective lamp housing is arranged around all these devices.

SUMMARY

In order to simplify the structure of such a lamp and at the same time to provide a lamp which at least with regard to cooling and emission of light fulfills the requirements in the above-mentioned prior art, the invention is based on the object to improve a lamp of the type mentioned above in that the lamp structure is simplified and the number of individual components of the lamp is reduced without disadvantages arising in terms of, for example, cooling or light emission from the lamp.

This object is satisfied by the features of claim 1.

The lamp according to the invention is in particular characterized in that an inner side of the lamp housing is formed, at least in some locations, as a reflection device and/or the cooling device is formed in one piece with the lamp housing.

This means that at least the reflection device or the cooling device is formed in one piece with the lamp housing, where either of these devices can be formed directly by the lamp housing.

For example, it is not necessary to allocate a separate cooling device to the light source or to arrange a separate reflection device within the lamp housing.

It is in a simple embodiment conceivable that the reflection device is formed as a coating on the inner side of the lamp housing. Depending on the material of the lamp housing, it is also conceivable that, for example, a polished inner side of the lamp housing is used as a reflection device. The reflection device is in particular arranged within the lamp housing such that light from the light source is deflected in the direction toward the light outlet opening. It can there prove to be sufficient, if, for example, only a portion of the inner side is formed as a reflection device.

Lamps are commonly used, for example, as linear lamps which have a greater length than width. It can in this context be advantageous if, for example, the housing is formed substantially semi-cylindrical, where the reflection device is at least in some locations formed along the curved half-cylindrical casing on its inner side.

To protect the interior of the lamp and in particular the lamp housing from contamination or from external intervention, the light outlet opening can be covered by a translucent or transparent cover plate. In can in this context further prove to be advantageous if the cover plate is at least supported on bearing edges encircling the light outlet opening. Such a support can be effected from the interior of the lamp housing, so that the cover plate does not protrude outwardly beyond the light outlet opening. For connecting the cover plate with the bearing edges, for example, a detachable connection or an adhesive bond or the like can be provided.

The bearing edges can there extend linearly or have other shapes, for example, in order to configure the light outlet opening as required.

Fluorescent tubes, halogen lamps or the like can be used as a light source, where preferably the use of a light source composed of a plurality of LEDs arranged on a circuit board is conceivable.

For uniform light output and sufficient lifespan, such LEDs commonly require relatively good cooling which is ensured by the cooling device integrated into the lamp housing. There is no longer the need for separate cooling devices in the lamp housing with possibly support from fans or the like.

In addition, such LED's can be actuated in a simple manner to allow for different lighting conditions.

This can be supported by respective lenses or reflection device, where such a reflection device is according to the invention formed on the inner side of the lamp housing. In is in this context further pointed out that the respective cover plate of the light outlet opening can exhibit a lens effect.

The printed circuit board equipped with respective LEDs can be arranged and fastened in different ways within the lamp housing. The use of multiple printed circuit boards with respective LEDs is additionally possible.

It is in one embodiment of the invention conceivable that the cooling device is formed on an outer side of the lamp housing. There is also the option that the cooling device is provided on the inner side of the lamp housing or on both the inner side and the outer side of the lamp housing.

In a simple embodiment, the cooling device can be formed by a number of cooling fins protruding outwardly from the outer side of the lamp housing. The cooling fins can each be disposed at the same distance or at different distances from each other, where, for example, a greater concentration of cooling fins can be provided in the vicinity of the light source.

It is also possible that the cooling fins each have the same height and/or length.

Openings are in a semi-cylindrical lamp housing also provided at opposite longitudinal ends of the housing and can advantageously be covered in particular by end cover plates detachably fastened on the lamp housing.

For easy fastening of such end cover plates on the lamp housing, support flanges can protrude on either longitudinal end from the outer side of the lamp housing, where fastening screws can be passed through said support flanges for detachably fastening the oppositely disposed end cover plates.

Several of these support flanges are commonly disposed along the longitudinal ends.

It has already been pointed out that the light source or also the printed circuit board, respectively, can with the plurality of LEDs be disposed on the inner side of the lamp housing. This also applies when using multiple light sources or multiple printed circuit boards with a respective number of LEDs.

The light source can in one embodiment be arranged, for example, directly on the inner side of the lamp housing. There is also the option that the inner side of the lamp housing comprises bearing flanges protruding into the housing interior for detachably fastening the light source. Detachably fastened on such a bearing flange is, for example, the circuit board.

This also applies analogously to respective further electrical or electronic devices which are arranged in the housing interior.

In a simple embodiment, the bearing flange can extend along the light outlet opening.

It is in this context also advantageous if possibly the bearing flange forms at least a portion of the edge of the light outlet opening. The light source can in this manner be arranged adjacent to the light outlet opening, where the light it emits exits by way of the reflection device through the light outlet opening toward the exterior from the lamp housing.

It has already been pointed out that the respective cover plate can be placed on bearing edges of the light outlet opening. It is in this context further optionally advantageous if the bearing flange is formed with at least one of the bearing edges.

BRIEF DESCRIPTION OF THE DRAWINGS

In the following, an advantageous embodiment of the invention is further illustrated using the figures appended in the drawing, where.

DETAILED DESCRIPTION OF EXAMPLE EMBODIMENTS

Figure 1:
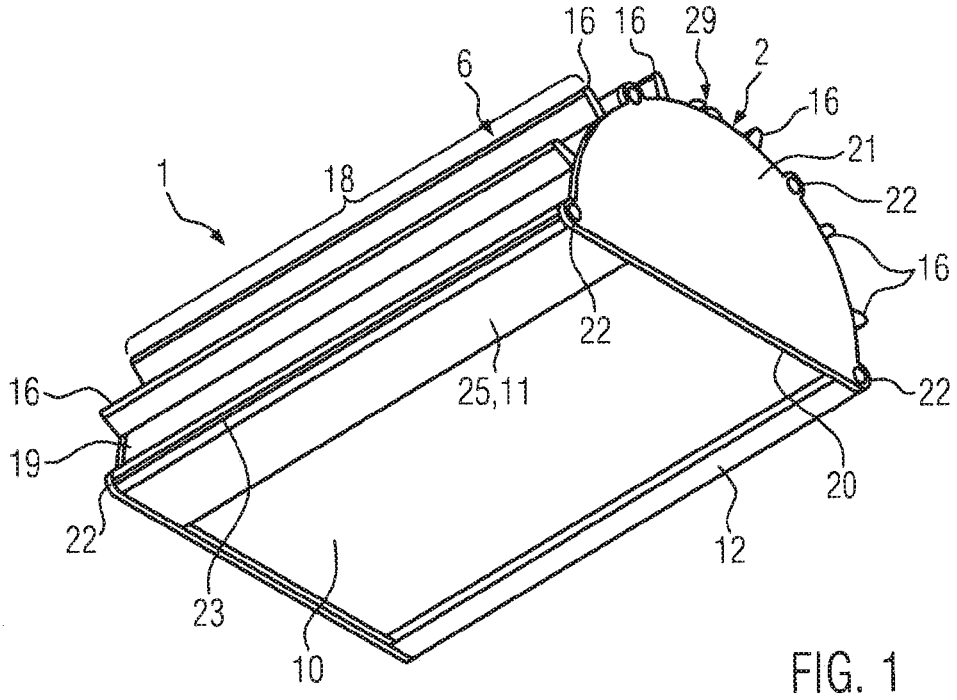
FIG. 1 shows a perspective view from below onto a lamp according to the invention and FIG. 2 shows a cross-sectional view through the lamp according to FIG. 1.

FIG. 1 illustrates a lamp 1 according to the invention in a perspective view obliquely from below. Such a lamp 1 can be configured as a recessed ceiling emergency lamp, as an explosion-proof lamp and/or as a linear lamp. Lamp 1 has a semi-cylindrical lamp housing 2, which on its underside comprises a light outlet opening 5 and also respective openings at longitudinal ends 19 and 20. Respective end cover plates 21 being fixed to each other by way of fastening screws 23 are provided to cover the openings at longitudinal ends 19, 20. In order to guide fastening screws 23 along an outer side 15 of lamp housing 2, support flanges 22 are provided at longitudinal ends 19, 20 through which fastening screws 23 are guided.

End cover plates 21 are approximately semi-circular in shape.

On outer side 15 of lamp housing 2, a cooling device 6 is further arranged in the form of a number of cooling fins 16. These cooling fins 16 are formed in one piece with lamp housing 2, see also FIG. 2. The cooling fins extend between the longitudinal ends over the entire length 18 of lamp housing 2 and each have the same height 17, see again FIG. 2.

Light outlet opening 5 is closed by a transparent or translucent cover plate 10. It rests from the housing interior 24 of lamp housing 2 on respective bearing edges 11, 12, see FIG. 2.

A bearing flange 25 is along one side of light outlet opening 5 arranged with a corresponding bearing edge 11 which has a greater width as compared with oppositely disposed bearing edge 12. At the uppermost point of lamp housing 2, a suspension device 29 or a fastening device 29, respectively, is further arranged with which lamp 1 can be fastened at the respective mounting location.

Figure 2:
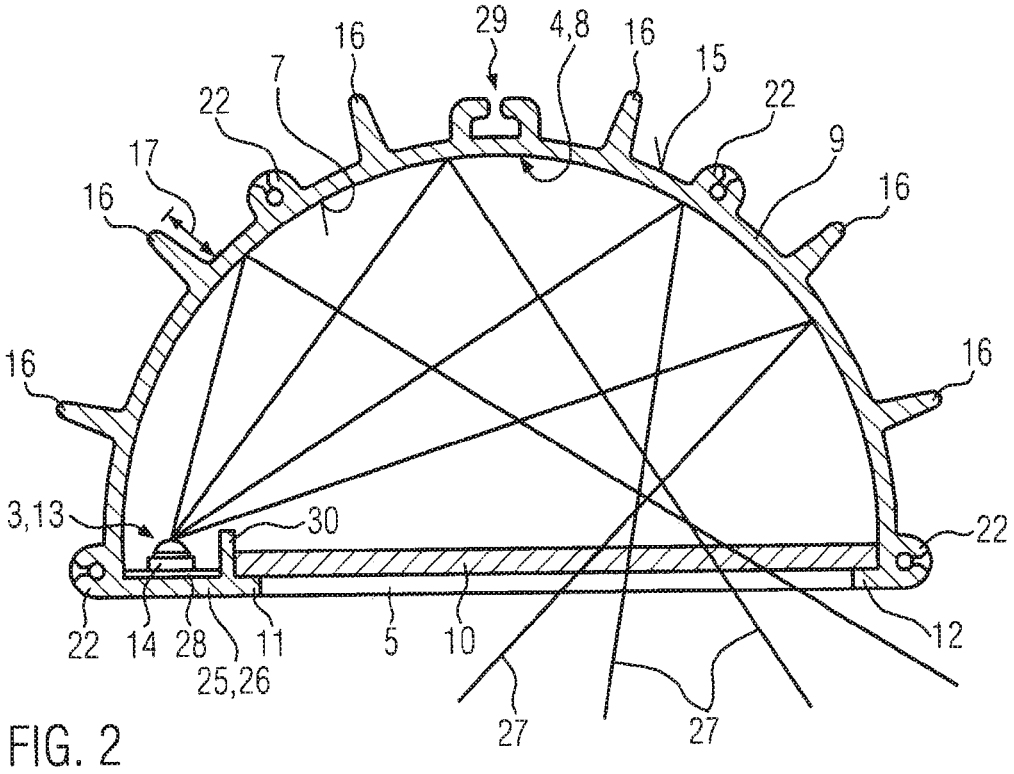

FIG. 2 shows a vertical sectional view through lamp 1 according to FIG. 1.

According to FIG. 2, five cooling fins 16 with height 17 and length 18, see FIG. 1, extend on outer side 15 of lamp housing 2. The cooling fins are arranged substantially equidistant, where, for example, support flanges 22 or suspension device 29 can be arranged between the cooling fins on lamp housing 2.

In the housing interior 24 on an inner side 7 of lamp housing 2, a reflection device 4 is formed It can be formed directly by inner side 7 of lamp housing 2 or also by a special reflective coating 8 of inner side 7. Reflection device 4 can be formed on the entire inner side 7 or only in part thereon, to reflect in particular light from a light source 3 in the direction toward lamp outlet opening 5, see the various light beams 27 according to FIG. 2.

Light source 3 is arranged on bearing flange 25 as part of an edge 26 of light outlet opening 5. Light source 3 is in the embodiment illustrated formed by a plurality of LEDs 13 being arranged on a printed circuit board 14. The latter is likewise directly connected to the respective bearing flange 25, for example, by adhesive bonding or the like.

It is at this point to be noted that a similar arrangement of a light source 3 can also be disposed on the opposite side of light outlet opening 5 so that respective light sources 3 can be provided on either side of light outlet opening 5.

According to FIG. 2, cover plate 10 is placed from the direction of housing interior 24 on respective bearing edges 11 and 12 of light outlet opening 5. Cover plate 10 can also be fastened, for example, by a detachable connection or the like.

In the embodiment illustrated, bearing edge 11 forms a portion of bearing flange 25, where a rib 30 extends vertically upwardly from bearing flange 25 into the housing interior for separating light source 3 from light outlet opening 5.

It also serves to fixate light source 3 and in particular circuit board 14 with LEDs 13 disposed thereon.

First heat dissipation from LEDs 13 can occur via the printed circuit board. There are a number of options for this. For example, special printed circuit board shapes can be used which exhibit particularly good thermal conductivity, such as printed circuit boards having a metal core. The heat of the LEDs can be passed, for example, to the metal core via a copper through-contact. The heat can then from the metal core be passed on directly to the lamp housing. Thermal conductivity can in this context be improved by heat-conductive paste or the like. Moreover, it is in this context of advantage if respective heat transfer is improved by mounting the printed circuit board without the surfaces to be joined being uneven and rough.

Due to the shape of lamp housing 2, the respective wall is formed substantially as a half-cylindrical casing 9, see also FIG. 1. This half-cylindrical casing comprises inner side 7 and outer side 15, respectively.

There is the further option that printed circuit board 14 is not placed directly on the upper side of bearing flange 25, but that, for example, a separation layer 28 is further disposed between them. It can also be formed as a heat conduction layer to enable improved heat transfer from sides of light source 3 in the direction of cooling device 6.

Lamp 1 according to the invention exhibits a simple structure with reflection device 4 and cooling device 6 being integrated in lamp housing 2. No additional devices for cooling or reflection are necessary, such as a cooling element, a fan, a holder separate from the lamp housing for the light source and the like.

Furthermore, devices for fastening end cover plates 21 or for fastening lamp 1, respectively, are already formed on at the lamp housing itself, cf. suspension device 29.

A lamp of an overall compact structure being composed of few individual components arises which can be inexpensively and quickly produced and is versatile in use. The respective bearing flange 25 for arranging circuit board 14 is in the embodiment illustrated indeed formed as a part of edge 26, where it is also conceivable that the respective cover plate 10 of light outlet opening 5 can be placed only on bearing edges 11 and 12, where, for example, the corresponding bearing flange 25 can protrude also elsewhere from inner side 7 of lamp housing 2 into the housing interior. This gives rise in a simple manner to different arrangement options for the light source, where also several such light sources can be disposed by way of several bearing flanges in one lamp housing 2.

The invention claimed is:

1. A lamp (1) comprising:

a lamp housing (2) that defines a light outlet opening (5), the lamp housing including:

a first bearing flange (25) and a second bearing edge (12) that extend along and into the light outlet opening (5), wherein the first bearing flange (25) is wider than the second bearing edge (12), a rib (30) protruding substantially perpendicular to the first bearing flange (25) from an inner surface of the first bearing flange (25) towards an inner surface (7) of a reflection wall (4) such that the rib (30) separates the first bearing flange (25) into a first bearing edge (11) and a light source retention portion, wherein the rib (30) is disposed proximal to the light outlet opening (5), such that the light source retention portion is disposed on one side of the rib (30) extending towards the reflection wall (4) and the first bearing edge (11) is disposed on an opposite side of the rib (30), and wherein the first bearing edge (11) extends towards the light outlet opening (5) and in the direction of the second bearing edge (12), the reflection wall (4) having a substantially semi-circular cross-sectional profile and disposed between the first bearing edge and the second bearing edge, the reflection wall (4) configured to deflect light emitted by a light source (3) toward the light outlet opening (5) of said lamp housing (2), wherein the reflection wall comprises the inner surface (7) and an outer surface (15) that define opposite surfaces of the reflection wall, each of the inner surface and the outer surface having the substantially semi-circular cross-sectional profile, wherein at least a portion of the inner surface (7) of the reflection wall of the lamp housing (2) is reflective, wherein the outer surface (15) of the reflection wall (4) of the lamp housing (2) defines a cooling device (6) that comprises a plurality of cooling fins (16) protruding radially outward from the outer surface (15) of the reflection wall (4), and wherein the first bearing flange (25), the second bearing edge (12), and the cooling fins (16) are integral to the reflection wall (4), the light source (3) disposed in the light source retention portion of the first bearing flange (25) and on the inner surface of the first bearing flange (25) such that the light source (3) is positioned adjacent to the light outlet opening (5) and facing the inner surface (7) of the reflection wall (4) of the lamp housing (2); and a transparent or translucent cover plate (10) that is disposed on and supported by an inner surface of the first bearing edge (11) and the second bearing edge (12) of the lamp housing (2) such that the cover plate (10) is disposed above the light outlet opening (5), covers the light outlet opening (5), and is disposed in an interior (24) of the lamp housing (2).

2. The lamp according to claim 1, characterized in that the inner surface of the reflection wall (4) is made reflective by applying a coating (8) on the inner side (7) of the reflective wall (4) of the lamp housing (2).

3. The lamp according to claim 1, characterized in that the light source (3) is formed by a plurality of LEDs (13) disposed on a printed circuit board (14).

4. The lamp according to claim 1, characterized in that the plurality of cooling fins (16) have the same height (17) and/or the same length (18).

5. The lamp according to claim 1, characterized in that openings at oppositely disposed longitudinal ends (19, 20) of said lamp housing (2) are covered by end cover plates (21) that are detachably fastened to said lamp housing.

6. The lamp according to claim 5, characterized in that support flanges (22) protrude in particular on either longitudinal end (19, 20) from the outer surface (15) of said lamp housing (2), through which support flanges (22) fastening screws (23) can be passed for detachably fastening said oppositely disposed end cover plates (21).

7. The lamp according to claim 1, further comprising a suspension device (29) that is formed on the outer surface of the reflective wall at an uppermost point of the lamp housing (2) and in between a pair of cooling fins of the plurality of cooling fins, the suspension device (29) configured to fasten the lamp to a mounting location.

8. The lamp according to claim 3, further comprising a separation layer (28) that is disposed on the bearing flange (25) such that the separation layer is disposed between the printed circuit board and the bearing flange to improve heat transfer from sides of the light source (3) in the direction of the cooling device defined by the reflection wall.

* * * * *